US008839984B2

(12) United States Patent
Sheehy

(10) Patent No.: US 8,839,984 B2
(45) Date of Patent: Sep. 23, 2014

(54) PAINT CAN ACCESSORY

(76) Inventor: Kevin B. Sheehy, Chicago, IL (US)

( * ) Notice: Subject to any disclaimer, the term of this patent is extended or adjusted under 35 U.S.C. 154(b) by 1006 days.

(21) Appl. No.: 12/589,143

(22) Filed: Oct. 19, 2009

(65) Prior Publication Data

US 2010/0089932 A1 Apr. 15, 2010

Related U.S. Application Data

(63) Continuation of application No. 12/287,812, filed on Oct. 14, 2008.

(51) Int. Cl.

| | |
|---|---|
| ***B05C 21/00*** | (2006.01) |
| ***B65D 1/34*** | (2006.01) |
| ***B65D 25/00*** | (2006.01) |
| ***B65D 90/00*** | (2006.01) |
| ***B65D 1/40*** | (2006.01) |
| ***B65D 3/28*** | (2006.01) |
| ***B65D 5/72*** | (2006.01) |
| ***B65D 25/40*** | (2006.01) |
| ***B65D 35/38*** | (2006.01) |
| ***A46B 17/02*** | (2006.01) |
| ***B44D 3/12*** | (2006.01) |

(52) U.S. Cl.

CPC ..... *B44D 3/123* (2013.01)
USPC ..... 220/700

(58) Field of Classification Search

CPC ..... B44D 3/12; B44D 3/123; B44D 3/126; B44D 3/128; B65D 25/20; B05C 21/00
USPC ..... 220/570, 573, 695, 700, 701, 696, 697, 220/703; 222/573; 248/110
See application file for complete search history.

(56) References Cited

U.S. PATENT DOCUMENTS

| | | | | |
|---|---|---|---|---|
| 2,546,040 | A * | 3/1951 | Murray | 222/465.1 |
| 3,899,107 | A * | 8/1975 | Gaal | 222/570 |
| 4,083,466 | A | 4/1978 | McManaway | |
| 4,299,340 | A | 11/1981 | Hrytzak | |
| 4,566,148 | A | 1/1986 | Rolin | |
| 4,865,282 | A | 9/1989 | Yonkman et al. | |
| 4,911,319 | A * | 3/1990 | DeJean | 222/570 |
| 5,123,576 | A * | 6/1992 | Lawrence | 222/570 |
| 5,195,662 | A | 3/1993 | Neff | |
| 5,727,708 | A | 3/1998 | Erickson | |
| 5,810,196 | A | 9/1998 | Lundy | |
| 6,213,338 | B1 | 4/2001 | Cogdill | |
| 6,247,600 | B1 | 6/2001 | Sullivan, Jr. | |
| 7,137,168 | B2 | 11/2006 | Mann | |

* cited by examiner

*Primary Examiner* — Fenn Mathew
*Assistant Examiner* — Andrew T Kirsch
(74) *Attorney, Agent, or Firm* — Wood, Phillips, Katz, Clark & Mortimer

(57) ABSTRACT

A paint accessory for use with a paint container has an open end with a cylindrical rim at the open end. A cover piece comprises an annular ring having a downwardly opening channel for receiving the cylindrical rim. A pour spout extends upwardly from the annular ring. A scraper blade extends inwardly from the annular ring opposite the pour spout. A pair of aligned brackets extend inwardly from the annular ring on opposite sides thereof. A grid comprises a frame having opposite sides and a mesh structure therebetween. The frame has slots on the opposite sides for removably receiving the aligned brackets to mount the grid in the container incident to the cover piece being received on the cylindrical rim, in use.

20 Claims, 6 Drawing Sheets

PAINT CAN ACCESSORY

CROSS REFERENCE TO RELATED APPLICATIONS

This application is a continuation-in-part of application Ser. No. 12/287,812 filed Oct. 14, 2008.

FIELD OF THE INVENTION

This invention relates to painting accessories and more particularly, a paint grid mountable to a removable cover.

BACKGROUND OF THE INVENTION

A metal paint can with a resealable, tightly fitting cover has been around for many years. This allowed paint to be sold in mass quantities in one gallon cans. Although standard paint cans are well suited to storing and shipping paint, they are not well adapted for usage as containers during the painting process.

A typical paint can includes a rolled metal rim having an annular depression for a lid. A bead is provided both on the inside and the outside of the rim. During use, a painter can dip the brush into the paint and use the inner bead to wipe off excess paint from the brush. However, doing so can result in excess paint being received in the depression. Moreover, when paint is poured from the can, the depression will often fill with paint. The paint in the depression can act as a source for dripping and spillage. Also, it can adhere to the lid when the lid is reinstalled on the can.

The present invention is directed to solving one or more of the problems discussed above in a novel and simple manner.

SUMMARY OF THE INVENTION

In accordance with the invention, there is provided a paint accessory comprising a cover piece mountable to a grid.

In accordance with one aspect of the invention, there is disclosed a paint accessory for use with a paint container having an open end with a cylindrical rim at the open end. The paint accessory comprises a cover piece comprising an annular ring including means for securing the annular ring to the cylindrical rim and a pair of aligned brackets extending inwardly from the annular ring on opposite sides thereof. A grid comprises a frame having opposite sides and a mesh structure therebetween. The frame has slots on the opposite sides for removably receiving the aligned brackets to mount the grid in the container incident to the cover piece being received on the cylindrical rim, in use.

It is a feature of the invention that the cover piece further comprises a pour spout extending upwardly from the annular ring centrally located between the aligned brackets.

It is another feature of the invention that the cover piece further comprises a scraper blade extending inwardly from the annular ring opposite the pour spout.

It is a further feature of the invention that the brackets are aligned off center of the annular ring spaced more closely to the spout than the scraper blade.

It is yet another feature of the invention that the cover piece has a handle extending outwardly from the annular ring. The grid may comprise a hanger opening aligned with the slots. The handle is of a size corresponding to the hanger opening so that the handle and the hanger opening are aligned incident to the cover piece being placed on the grid for storage.

It is another feature of the invention that the brackets hingedly mount the grids to the cover piece.

It is an additional feature of the invention that the brackets have aligned depressions received in the slots to capture the grid on the brackets.

It is yet another feature of the invention that the grid comprises arms extending outwardly beneath each slot to limit movement of the grid relative to the cover piece.

There is disclosed in accordance with another aspect of the invention a paint accessory for use with a paint container having an open end with a cylindrical rim at the open end. A cover piece comprises an annular ring having a downwardly opening channel for receiving the cylindrical rim. A pour spout extends upwardly from the annular ring. A scraper blade extends inwardly from the annular ring opposite the pour spout. A pair of aligned brackets extend inwardly from the annular ring on opposite sides thereof. A grid comprises a frame having opposite sides and a mesh structure therebetween. The frame has slots on the opposite sides for removably receiving the aligned brackets to mount the grid in the container incident to the cover piece being received on the cylindrical rim, in use.

Further features and advantages of the invention will be readily apparent from the specification and from the drawings.

DETAILED DESCRIPTION OF THE INVENTION

Figure 1:
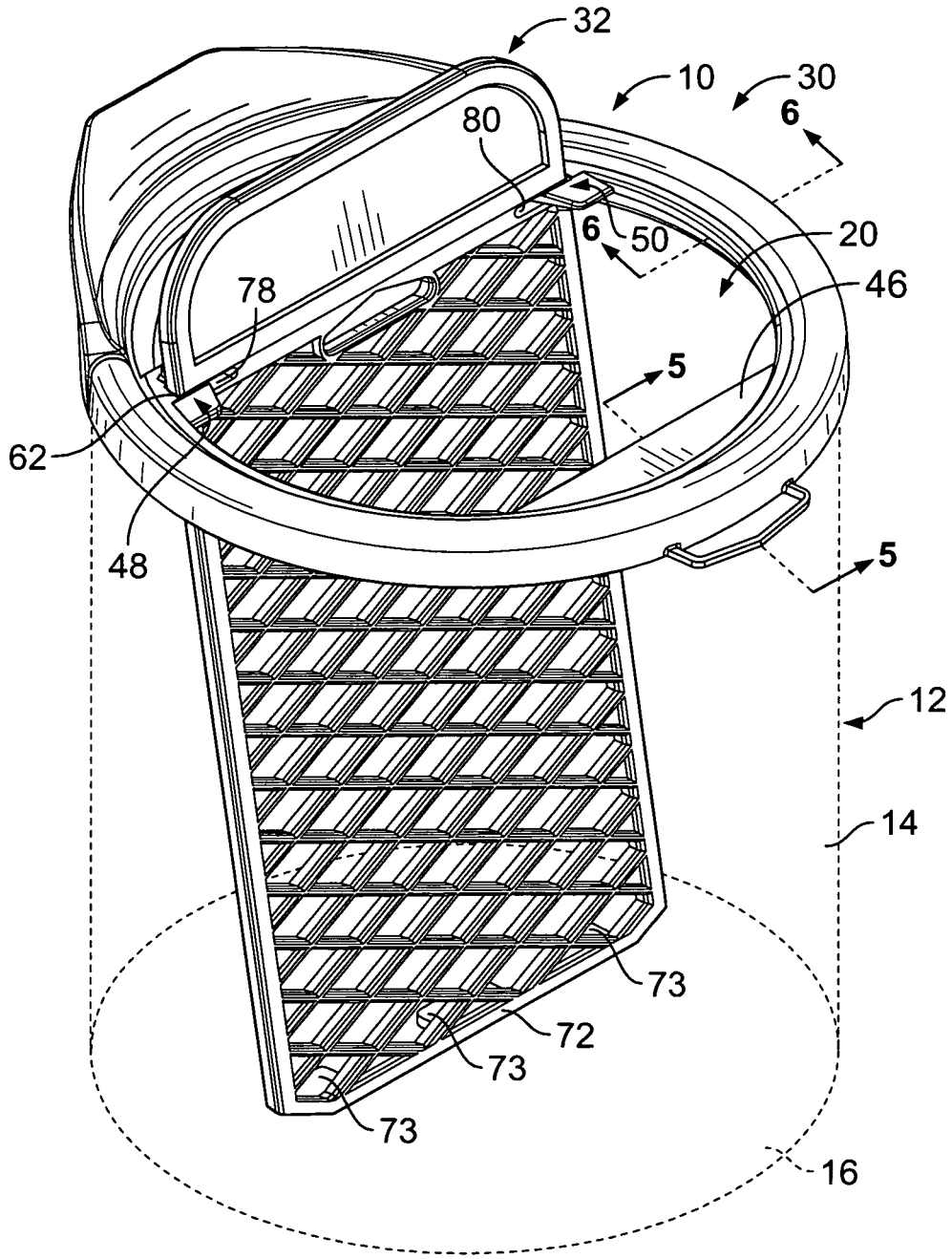
FIG. 1 is a perspective view of a paint accessory in accordance with the invention mounted in a paint can.
Figure 5:
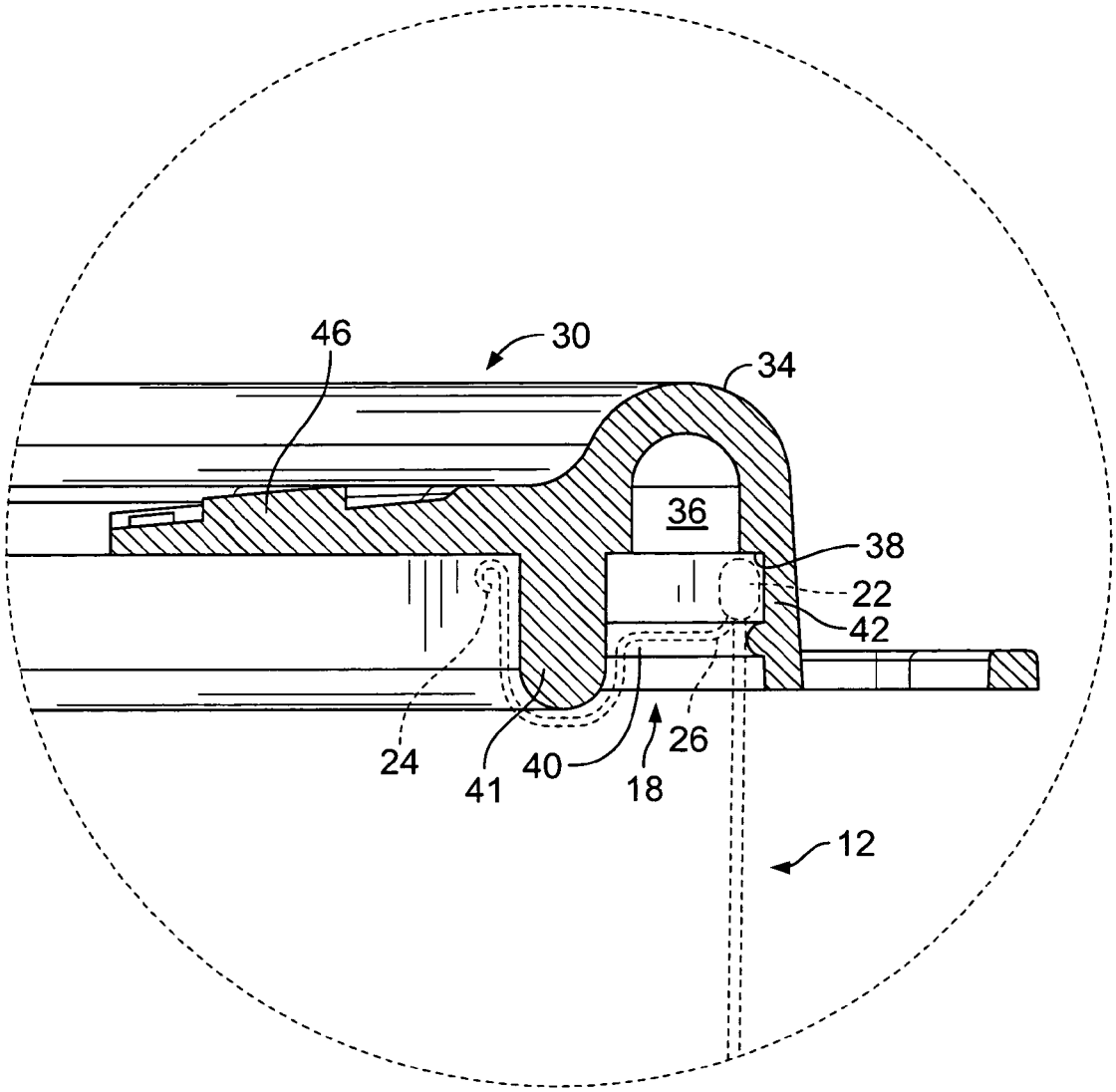
FIG. 5 is a sectional view taken along the line 5-5 of FIG. 1.

Referring initially to FIG. 1, a paint accessory 10 is illustrated for use with a paint container 12. The paint container 12 comprises a cylindrical side wall 14 closed by a bottom wall 16. A cylindrical rim 18, see FIG. 5, is at an upper end of the cylindrical wall 14 to define an open top end 20. The cylindrical rim 18 is formed to include an outer bead 22, an inner bead 24 and a depression therebetween formed by an indented wall 26, as is conventional.

As described below, the paint accessory 10 comprises an accessory for use with a conventional one gallon paint can. The particular configuration of the paint can itself does not form part of the invention.

Figure 2:
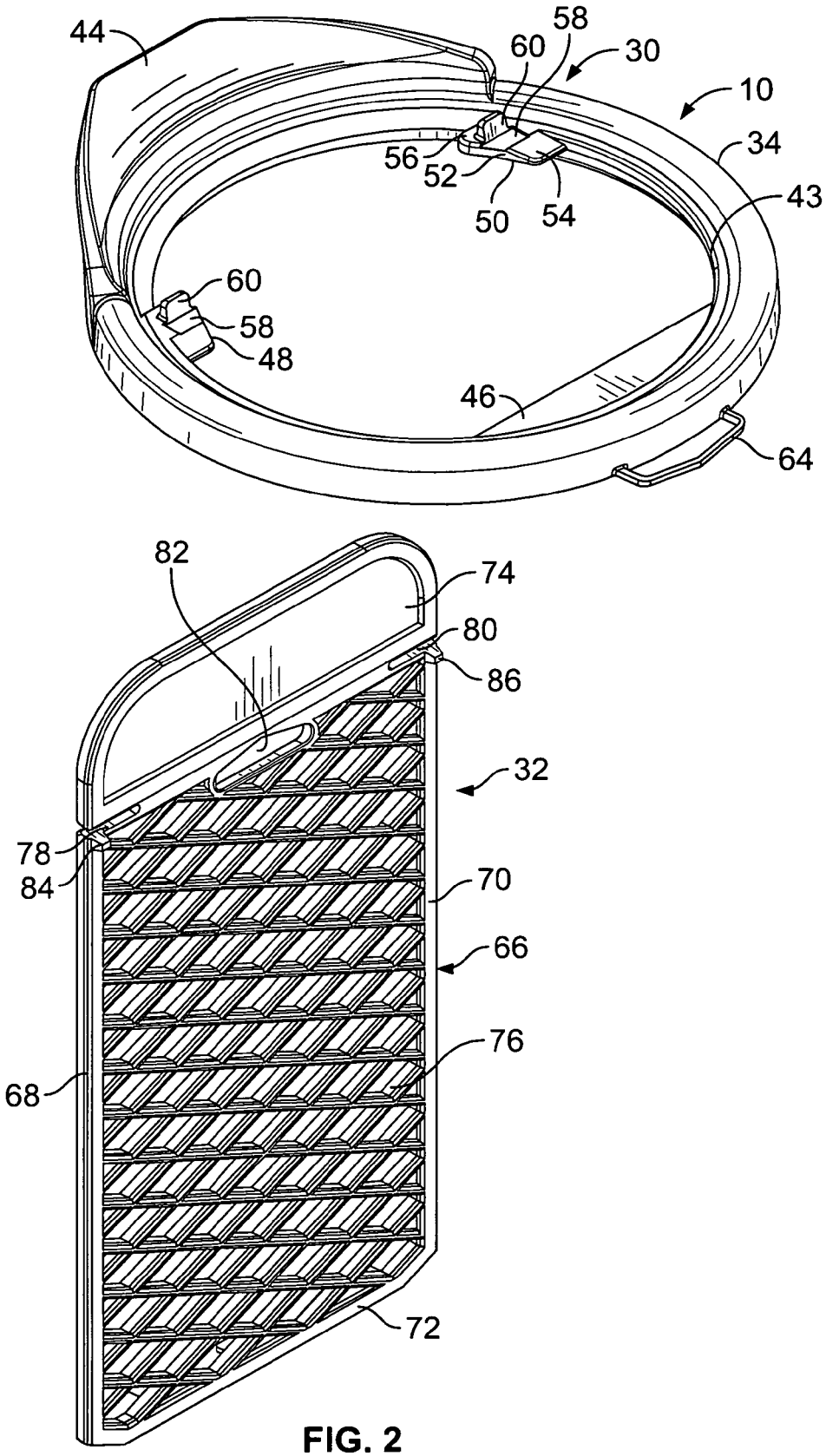
FIG. 2 is an exploded view of the paint accessory of FIG. 1.

Referring particularly to FIG. 2, the paint accessory 10 comprises a cover piece 30 and a grid 32. The cover piece 30 is of one piece plastic construction and may be formed, for example, by injection molding. The cover piece 30 may be formed of, for example, polypropylene, thermoplastic, elastomers, rubber, or the like. Likewise, the grid 32 is of one piece plastic construction. The grid 32 may also be formed by injection molding. The grid 32 would advantageously be of a rigid material.

Figure 6:
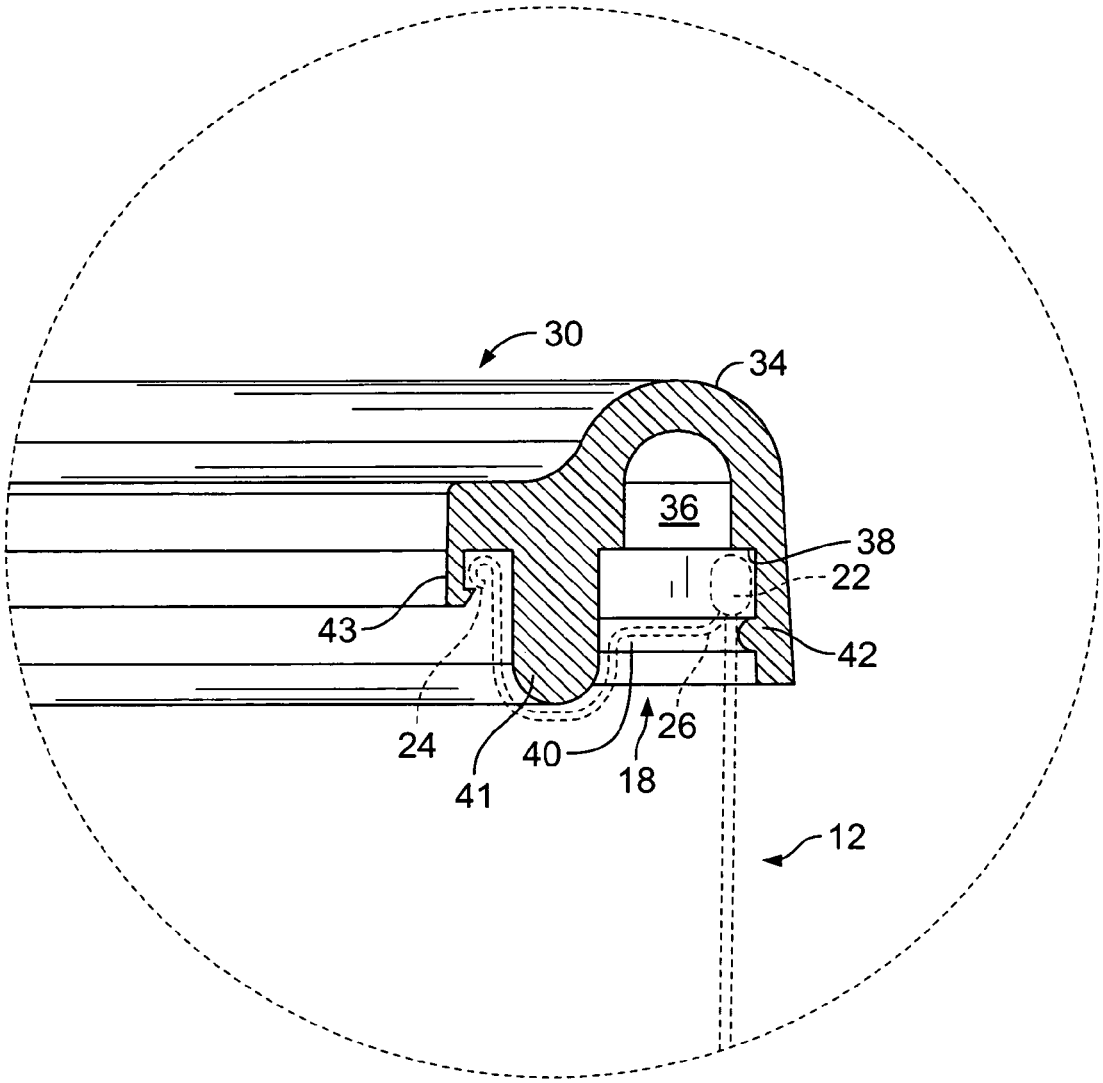
FIG. 6 is a sectional view taken along the line 6-6 of FIG. 1.

The cover piece 30 comprises an annular ring 34 having a downwardly opening channel 36, see FIG. 5, for receiving the cylindrical rim 18. Particularly, the annular ring 34 is of an inverted U-shape cross section formed by an inner wall 41 and an outer wall 42. The channel 36 is enlarged at a bottom defining a shoulder 38. A rim 40 extends inwardly from the outer wall 42. A collar 43 extends inwardly and downwardly from the inner wall 41. When mounted on the paint container 12 the inner bead 24 rests outside the collar 43 and inside the inner wall 41, see FIG. 6. The inner wall 41 is received in the depression 26. The rib 40 and shoulder 38 sandwich the outer bead 22 to secure the cover piece 30 on the container 10. As will be apparent, other structure could be used for securing the cover piece 30 to the container 12. For example, the mounting structure could be as is disclosed in my application Ser. No. 12/287,812 filed Oct. 4, 2008, the specification of which is incorporated by reference herein. Alternatively, the cover piece could have a flexible collar engaging the inner bead 24.

A pour spout 44 extends upwardly from the annular ring 34. A scraper blade 46 extends inwardly from the annular ring 34 opposite the pour spout 44. The scraper blade 46 slopes downwardly, as shown in FIG. 5. A flange structure in the form of a pair of brackets 48 and 50 extend inwardly from the annular ring 34 on opposite sides thereof between the pour spout 44 and the scraper blade 46. The brackets 48 and 50 are off centered relative to the annular ring 30. Particularly, if the pour spout is centered at approximately a 12 o'clock position and the scraper blade 46 at a 6 o'clock position, then the brackets 48 and 50 are at about a 10 o'clock and 2 o'clock positions, respectively. A handle 64 extends outwardly from the annular ring 34 opposite the scraper blade 46.

The second bracket 50 comprises a planar element 52 having a tapered front portion 54 and raised rear portion 56 defining a depression 58. A stop 60 extends upwardly from the raised rear portion 56 adjacent the depression 58. The first bracket 48 is a mirror image of the second bracket 50. The brackets are positioned so that the depression 58 of the second bracket 50 is linearly aligned with a corresponding depression 58 of the first bracket 48.

The grid 32 comprises a frame 66 formed by opposite sides 68 and 70 connected by a bottom 72 and an enlarged top 74. Feet 73 extend perpendicular from the bottom 72. The feet 73 rest on a bottom wall of the can, in use. A mesh structure 76 is enclosed by the frame 66. Opposite slots 78 and 80 are provided in the top portion 74, adjacent the respective sides 68 and 70, just above the mesh structure 76. A hanger opening 82 is provided in the mesh structure 66 just below the top portion 74. An arm 84 extends outwardly from the side 68 just below the slot 78. Similarly, an arm 86 extends outwardly from the side 70 just below the second slot 80.

Figure 4:
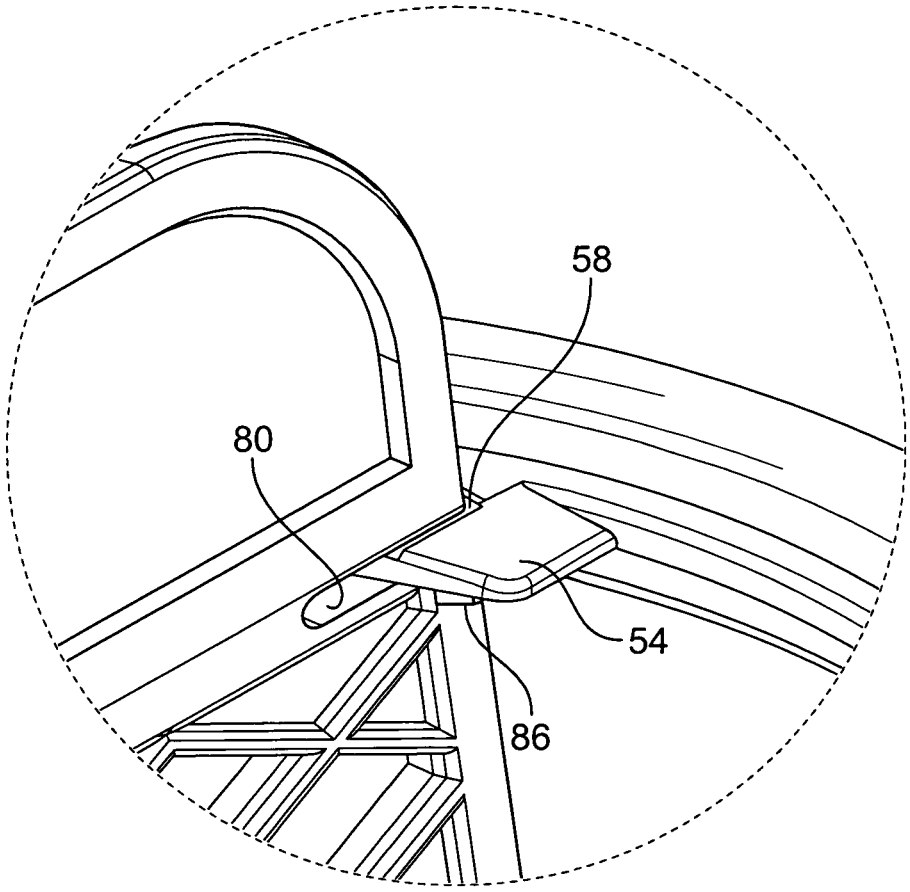
FIG. 4 is a detailed view illustrating mounting of a grid to a cover piece of the paint accessory.

In use, the grid 32 is mounted to the cover piece 30 by positioning it within the annular ring 34. The grid 32 is then snapped onto the brackets 48 and 50 by aligning the slots 78 and 80 with the brackets 48 and 50, respectively, and pushing the grid 32 so that the slots 78 and 80 ride up the tapered portions 54, until the slots 78 and 80 are captured in the depressions 58, as seen in FIG. 4 for the slot 80. Owing to the described configuration, the grid 32 is mounted to the annular ring 34. The grid 32 is hingedly mounted to allow some movement of the grid 32. However, such movement is limited by the arms 60 and also the bottom 72 abutting the container bottom wall 16, as shown in FIG. 1. Also, the grid arms 82 and 86 abut under sides of the respective brackets 48 and 50, see FIG. 4, to further limit movement.

Alternatively, the brackets could be replaced with an inwardly directed annular flange extending around an inside of the cover piece and the grid slots 78 and 80 could receive the flange.

Figure 3:
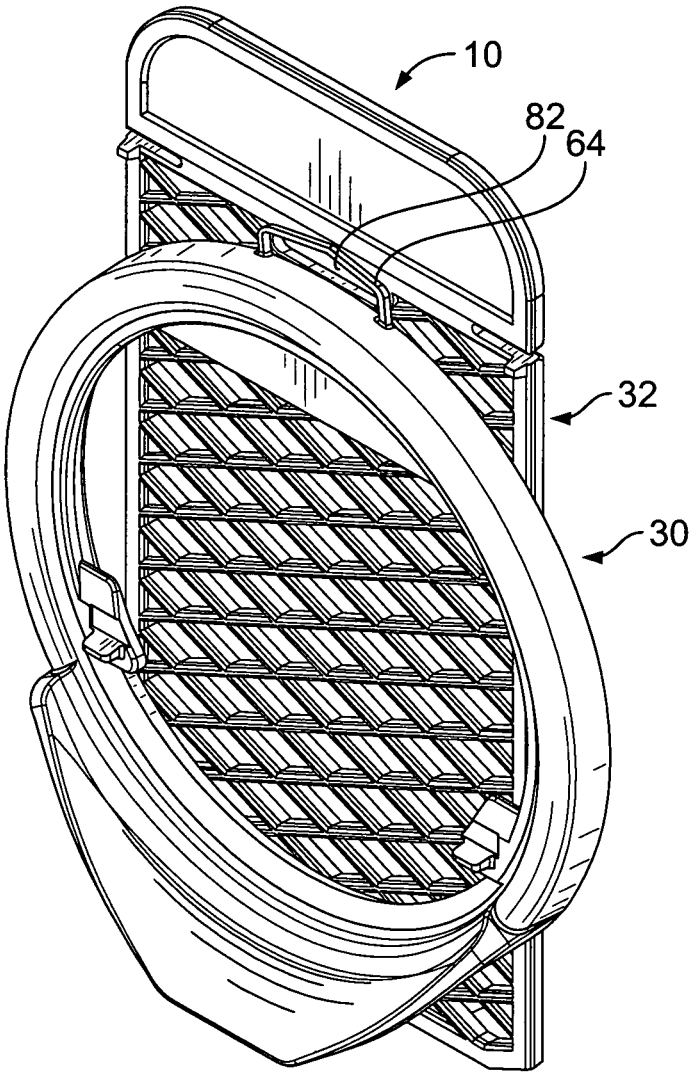
FIG. 3 is a perspective view of the paint accessory of FIG. 1 shown in a storage configuration.

For storage, and/or shipping, the cover piece 30 can be positioned on the grid 32 with the handle 64 aligned with the hanger opening 82, as shown in FIG. 3. This allows the paint accessory 10 to be assembled in a generally flat configuration to minimize space for display in a store and/or packaged efficiently, as well as for hanging in a workshop or the like, when not in use.

Thus, in accordance with the invention, there is provided a paint accessory 10 for use with a paint container 12 and comprising a grid 32 removably mounted to a cover piece 30. In use, the cover piece 30 has a spout 44 for pouring paint from the container while also providing the scraper blade 46 for cleaning a brush and the grid 32 for cleaning a brush and/or roller when withdrawing the same from the container. Further, the annular ring 30 acts to cover the container rim depression see FIG. 5, to prevent paint from filling the depression therein.

As is apparent, the embodiments shown herein are for illustration only. Modifications may be made without departing from the spirit and scope of the invention.

I claim:

1. A paint accessory for use with a paint container having an open end with a cylindrical rim at the open end, the paint accessory comprising:

a cover piece comprising an annular ring including means for securing the annular ring to the cylindrical rim and first and second flanges extending inwardly from the annular ring on opposite sides thereof so that spacing between the first and second flanges is less than an inner diameter of the cylindrical rim; and a grid comprising a frame having opposite sides and a mesh structure therebetween, the frame having a width less than the inner diameter of the cylindrical rim but greater than the spacing between the first and second flanges, the frame having slots extending inwardly from outer edges of the frame on the opposite sides for removably receiving the flanges to mount the grid in the container incident to the cover piece being received on the cylindrical rim, in use.

2. The paint accessory of claim 1 wherein the cover piece further comprises a pour spout extending upwardly from the annular ring centrally located between the first and second flanges.

3. The paint accessory of claim 2 wherein the cover piece further comprises a scraper blade extending inwardly from the annular ring opposite the pour spout.

4. The paint accessory of claim 1 wherein the first and second flanges comprises a pair of brackets aligned off-center of the annular ring.

5. The paint accessory of claim 1 wherein the cover piece further comprises a handle extending outwardly from the annular ring.

6. The paint accessory of claim 5 wherein the grid further comprises a hanger opening aligned with the slots.

7. The paint accessory of claim 6 wherein the handle is of a size corresponding to the hanger opening so that the handle and the hanger opening are aligned incident to the cover piece being placed on the grid for storage.

8. The paint accessory of claim 4 wherein the brackets hingedly mount the grid to the cover piece.

9. The paint accessory of claim 4 wherein the brackets have aligned depressions received in the slots to capture the grid on the brackets.

10. The paint accessory of claim 1 wherein the grid comprises arms extending outwardly beneath each slot to limit movement of the grid relative to the cover piece.

11. A paint accessory for use with a paint container having an open end with a cylindrical rim at the open end, the paint accessory comprising:

a cover piece comprising an annular ring having a downwardly opening channel for receiving the cylindrical rim, a pour spout extending upwardly from the annular ring, a scraper blade extending inwardly from the annular ring opposite the pour spout and a pair of aligned brackets extending inwardly from the annular ring on opposite sides thereof so that spacing between the aligned brackets is less than an inner diameter of the cylindrical rim; and a grid comprising a frame having opposite sides and a mesh structure therebetween, the frame having a width less than the inner diameter of the cylindrical rim but greater than the spacing between the aligned brackets, the frame having slots extending inwardly from outer edges of the frame on the opposite sides for removably receiving the aligned brackets to mount the grid in the container incident to the cover piece being received on the cylindrical rim, in use.

12. The paint accessory of claim 11 wherein the brackets are aligned off-center of the annular ring spaced more closely to the spout than the scraper blade.

13. The paint accessory of claim 11 wherein the cover piece further comprises a handle extending outwardly from the annular ring.

14. The paint accessory of claim 13 wherein the grid further comprises a hanger opening aligned with the slots.

15. The paint accessory of claim 14 wherein the handle is of a size corresponding to the hanger opening so that the handle and the hanger opening are aligned incident to the cover piece being placed on the grid for storage.

16. The paint accessory of claim 11 wherein the brackets have aligned depressions received in the slots to capture the grid on the brackets.

17. The paint accessory of claim 11 wherein the brackets hingedly mount the grid to the cover piece.

18. The paint accessory of claim 11 wherein the grid comprises arms extending outwardly beneath each slot to limit movement of the grid relative to the cover piece.

19. The paint accessory of claim 11 wherein the cover piece is of one-piece plastic construction.

20. The paint accessory of claim 11 wherein the grid is of one-piece plastic construction.

* * * * *